US010003898B1

(12) United States Patent
Bjorn et al.

(10) Patent No.: US 10,003,898 B1
(45) Date of Patent: Jun. 19, 2018

(54) FLEXIBLE CONNECTION BONE CONDUCTION DEVICE

(71) Applicants: Goran Bjorn, Onsala (SE); Marcus Andersson, Gothenburg (SE); Stefan Magnander, Gothenburg (SE); James F. Patrick, Roseville (AU); Wim Bervoets, Wilrijk (BE)

(72) Inventors: Goran Bjorn, Onsala (SE); Marcus Andersson, Gothenburg (SE); Stefan Magnander, Gothenburg (SE); James F. Patrick, Roseville (AU); Wim Bervoets, Wilrijk (BE)

(73) Assignee: Cochlear Limited, Macquarie University, NSW (AU)

( * ) Notice: Subject to any disclaimer, the term of this patent is extended or adjusted under 35 U.S.C. 154(b) by 429 days.

(21) Appl. No.: 14/182,816

(22) Filed: Feb. 18, 2014

Related U.S. Application Data

(60) Provisional application No. 61/765,578, filed on Feb. 15, 2013.

(51) Int. Cl.
*H04R 25/00* (2006.01)

(52) U.S. Cl.
CPC ..... *H04R 25/606* (2013.01)

(58) Field of Classification Search
CPC ..... H04R 25/00; H04R 25/48; H04R 25/55; H04R 25/60; H04R 25/604; H04R 25/606; H04R 25/608; H04R 25/65; H04R 2225/025; H04R 2225/67
See application file for complete search history.

(56) References Cited

U.S. PATENT DOCUMENTS

| | | | | |
|---|---|---|---|---|
| 4,571,133 | A * | 2/1986 | Lindow | 411/11 |
| 5,180,303 | A * | 1/1993 | Hornburg et al. | 433/173 |
| 5,584,629 | A * | 12/1996 | Bailey et al. | 411/178 |
| 5,735,790 | A * | 4/1998 | Hangkansson | H04R 25/606 600/25 |
| 2003/0229262 | A1* | 12/2003 | Easter et al. | 600/25 |
| 2004/0032962 | A1* | 2/2004 | Westerkull | 381/151 |
| 2005/0249366 | A1* | 11/2005 | Westerkull | H04R 25/606 381/151 |
| 2006/0087203 | A1* | 4/2006 | Cho | H04R 25/606 310/353 |
| 2007/0156011 | A1* | 7/2007 | Westerkull | 600/25 |
| 2009/0023109 | A1* | 1/2009 | Jinton et al. | 433/174 |
| 2010/0145135 | A1* | 6/2010 | Ball | H04R 25/606 600/25 |
| 2010/0292529 | A1* | 11/2010 | Westerkull et al. | 600/25 |
| 2011/0152601 | A1* | 6/2011 | Puria | H04R 25/606 600/25 |
| 2011/0270326 | A1* | 11/2011 | Black et al. | 606/308 |
| 2012/0095283 | A1* | 4/2012 | Andersson et al. | 600/25 |
| 2012/0108887 | A1* | 5/2012 | Vermeiren | H04R 25/606 600/25 |

(Continued)

*Primary Examiner* — Thaddeus Cox
(74) *Attorney, Agent, or Firm* — Martin J. Cosenza; Pilloff & Passino LLP

(57) ABSTRACT

A device including an implantable assembly. The assembly includes a bone fixture configured to anchor to bone of a recipient, and a vibratory apparatus configured to be completely implanted beneath the skin of a recipient, wherein the implantable assembly is configured such that the vibratory apparatus can move relative to the bone fixture while implanted in a recipient.

37 Claims, 12 Drawing Sheets

(56) References Cited

U.S. PATENT DOCUMENTS

| | | | | |
|---|---|---|---|---|
| 2012/0290010 | A1* | 11/2012 | Zamani et al. | 606/264 |
| 2012/0302822 | A1* | 11/2012 | Van Himbeeck | H04R 25/606 600/25 |
| 2013/0035540 | A1* | 2/2013 | Ball | A61N 1/36032 600/25 |
| 2013/0338427 | A1* | 12/2013 | Maier | H04R 25/606 600/25 |
| 2014/0012070 | A1* | 1/2014 | Nagl | H04R 25/00 600/25 |

* cited by examiner

FLEXIBLE CONNECTION BONE CONDUCTION DEVICE

CROSS-REFERENCE TO RELATED APPLICATIONS

This application claims priority to U.S. Provisional Patent Application No. 61/765,578, entitled Flexible Connection Bone Conduction Device, filed on Feb. 15, 2013, naming Goran Bjorn as an inventor, the contents of that application being incorporated herein by reference in its entirety.

BACKGROUND

The present disclosure relates generally to bone conduction devices, and more particularly, to transcutaneous bone conduction.

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants include an electrode array for implantation in the cochlea to deliver electrical stimuli to the auditory nerve, thereby causing a hearing percept.

Conductive hearing loss occurs when the normal mechanical pathways that provide sound to hair cells in the cochlea are impeded, for example, by damage to the ossicular chain or ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses a component positioned at the recipient's auricle or ear canal which amplifies received sound. This amplified sound reaches the cochlea causing stimulation of the auditory nerve.

In contrast to hearing aids, certain types of hearing prostheses commonly referred to as bone conduction devices convert a received sound into mechanical vibrations. The vibrations are transferred through the skull or jawbone to the cochlea causing generation of nerve impulses, which result in the perception of the received sound. Bone conduction devices may be a suitable alternative for individuals who cannot derive sufficient benefit from acoustic hearing aids, cochlear implants, etc.

SUMMARY

The terms "invention," "the invention," "this invention," "the present invention," "disclosure," "the disclosure," "this disclosure" and "the present disclosure" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is an overview of various aspects and embodiments of the invention(s) and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent application, any or all drawings and each claim.

In accordance with one aspect of the present disclosure, there is an implantable component of a prosthesis, comprising a bone fixture and one or more magnets disposed in a housing coupled to the bone fixture via a structure that extends from the housing to the bone fixture.

In accordance with another aspect of the present disclosure, the coupling is adapted to permit limited movement of the housing relative to the bone fixture to accommodate trauma. It is utilitarian for couplings adapted to accommodate trauma for the coupling to transmit vibrations of the magnets and magnet housing to be transmitted to the fixture in order for the communication of sound to be accomplished through bone conduction.

In accordance with another aspect of the present disclosure, there is an implantable hearing prosthesis, comprising a bone fixture and at least one magnet disposed in a housing, wherein the housing is flexibly coupled to the bone fixture.

BRIEF DESCRIPTION OF THE DRAWINGS

Embodiments of the present disclosure are described below with reference to the attached drawings, in which.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Aspects of the present disclosure are generally directed to a transcutaneous bone conduction device configured to deliver mechanical vibrations generated by a vibrator to a recipient's cochlea via the skull to cause a hearing percept. In certain transcutaneous bone conduction devices, sometimes referred to as passive transcutaneous bone conduction devices, the vibrator is located in an external component of the device, while in other transcutaneous bone conduction devices, sometimes referred to as active transcutaneous bone conduction devices, the vibrator is located in an internal component. When implemented in a passive transcutaneous bone conduction device, the bone conduction device includes an implantable bone fixture adapted to be secured to the skull, and one or more magnets disposed in a housing coupled to the bone fixture via one of several possible structures that are sufficiently flexible to withstand some possible trauma. When implanted, the one or more magnets are capable of forming a magnetic coupling with the external vibrator sufficient to permit effective transfer of the mechanical vibrations to the implanted magnets, which are then transferred to the skull via the bone fixture. When implemented in an active transcutaneous bone conduction device, the bone conduction device includes an implantable bone fixture adapted to be secured to the skull, and a vibrator disposed in a housing coupled to the bone fixture via one of several possible structures that are sufficiently flexible to withstand some possible trauma. When implanted, the mechanical vibrations generated by the internal generator are then transferred to the skull via the bone fixture.

Figure 1:
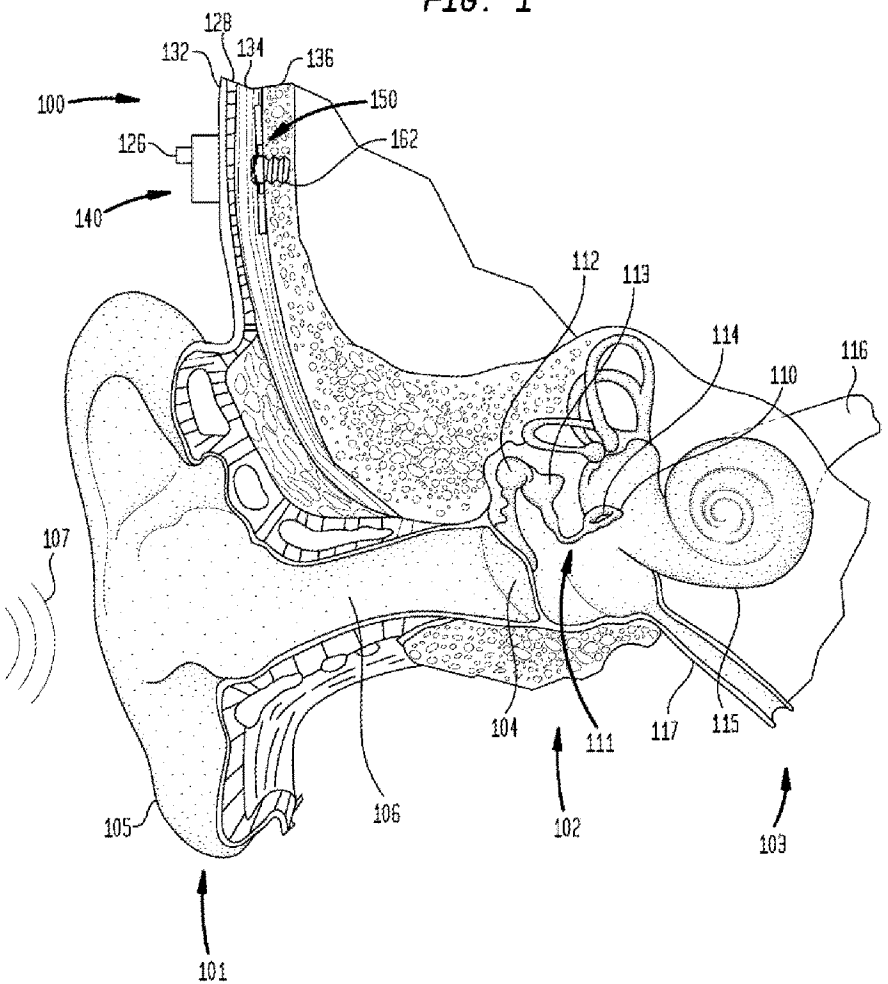
FIG. 1 is a perspective view of an exemplary bone conduction device in which embodiments of the present disclosure may be implemented.

FIG. 1 is a perspective view of an exemplary transcutaneous bone conduction device, namely a passive transcutaneous bone conduction device 100. As shown, the recipient has an outer ear 101, a middle ear 102 and an inner ear 103. In a fully functional human hearing anatomy, outer ear 101 comprises an auricle 105 and an ear canal 106. In a functional human ear, sound waves 107 are collected by auricle 105 and channeled into ear canal 106. Disposed across the distal end of ear canal 106 is a tympanic membrane 104 which vibrates in response to acoustic wave 107. This vibration is coupled to oval window or fenestra ovalis 110 through three bones of middle ear 102, collectively referred to as the ossicles 111 and comprising the malleus 112, the incus 113 and the stapes 114. Ossicles 111 serve to filter and amplify acoustic wave 107, causing oval window 110 to vibrate. Such vibration sets up waves of fluid motion within cochlea 139 which, in turn, activates hair cells lining the inside of the cochlea. Activation of the hair cells causes appropriate nerve impulses to be transferred through the spiral ganglion cells and auditory nerve 116 to the brain, where they are perceived as sound.

FIG. 1 also illustrates the positioning of bone conduction device 100 on the recipient. As shown, bone conduction device 100 is secured to the skull behind outer ear 101. Bone conduction device 100 comprises an external component 140 that includes a sound input element 126 to receive sound signals. Sound input element 126 may comprise, for example, a microphone, telecoil, etc. In an exemplary embodiment, sound input element 126 may be located, for example, on or in bone conduction device 100, on a cable or tube extending from bone conduction device 100, etc. Alternatively, sound input element 126 may be subcutaneously implanted in the recipient, or positioned in the recipient's ear. Sound input element 126 may also be a component that receives an electronic signal indicative of sound, such as, for example, from an external audio device or a microphone.

External component 140 also comprises a sound processor (not shown), an actuator (also not shown) and/or various other functional components. In operation, sound input device 126 converts received sound into electrical signals. These electrical signals are processed by the sound processor to generate control signals that cause the actuator to vibrate. The actuator converts the electrical signals into mechanical vibrations for delivery to internal component 150.

Internal component 150 comprises a bone fixture 162 such as a bone screw to secure an implantable magnetic component 164 to skull 136. Typically, bone fixture 162 is configured to osseointegrate into skull 136. Magnetic component 164 forms a magnetic coupling with one or more magnets disposed in external component 140 sufficient to permit effective transfer of the mechanical vibrations to internal component 150, which are then transferred to the skull.

The exemplary transcutaneous bone conduction device illustrated in FIG. 1 has all active components, such as the actuator, located externally. As noted, such a bone conduction device is commonly referred to as a passive transcutaneous bone conduction device. It should be appreciated, however, that embodiments of the present disclosure may be implemented in other medical devices as well, including active transcutaneous bone conduction devices, as noted above. In such applications, the vibrator is coupled to the bone fixture via a structure sufficiently flexible to withstand some possible trauma.

Figure 2A:
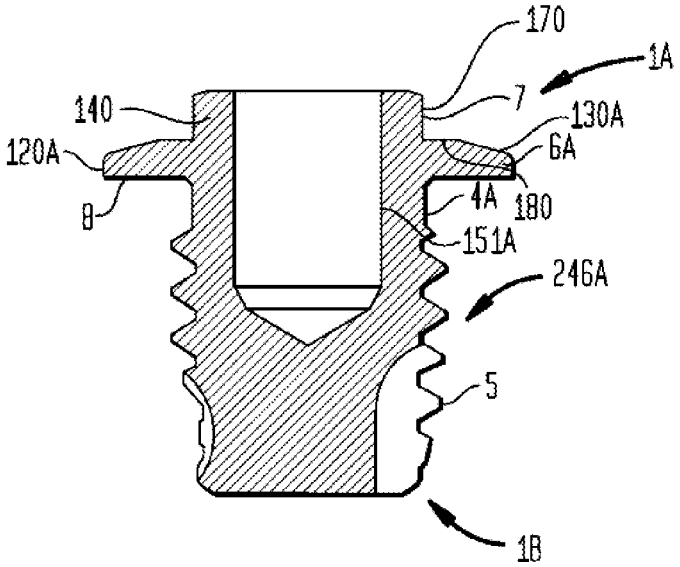
FIGS. 2A and 2B are cross-sectional diagrams of exemplary bone fixtures with which embodiments of the present disclosure may be implemented.
Figure 2B:
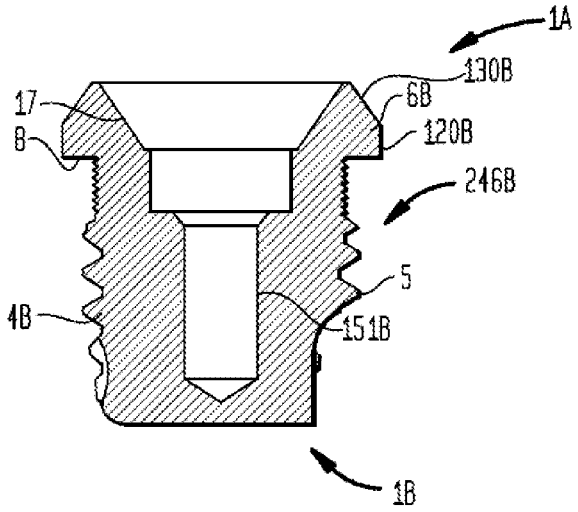

FIGS. 2A and 2B are cross-sectional views of bone fixtures 246A and 246B that may be used in exemplary embodiments of the present disclosure. Bone fixtures 246 are configured to receive an abutment, as is known in the art, where an abutment screw is used to attach the abutment to the bone fixtures, as will be detailed below.

Bone fixtures 246 may be made of any material that has a known ability to integrate into surrounding bone tissue (i.e., it is made of a material that exhibits acceptable osseointegration characteristics). In one embodiment, bone fixtures 246 are made of titanium.

As shown, each bone fixture 246 includes a main body 4A, 4B, respectively, and an outer screw thread 5 configured to be implanted into the skull. Fixtures 246A and 246B also each respectively comprise flanges 6A and 6B configured to abut the skull thereby preventing the fixtures from being inserted further into the skull. Fixtures 246 may further comprise a tool-engaging socket having an internal grip section for easy lifting and handling of the fixtures. Tool-engaging sockets and the internal grip sections usable in bone fixtures according to some embodiments of the present disclosure are described and illustrated in International Patent Publications WO2009/015102 and WO2009/015103.

Main bodies 4A and 4B have a length that is sufficient to securely anchor the bone fixtures into the skull without penetrating entirely through the skull. The length of main bodies 4A and 4B may depend, for example, on the thickness of the skull at the implantation site. In one embodiment, the main bodies of the fixtures have a length that is no greater than 5 mm, measured from the planar bottom surface 8 of the flanges 6A and 6B to the end of the distal region 1B. In another embodiment, the length of the main bodies is from about 3.0 mm to about 5.0 mm.

In the embodiment depicted in FIG. 2A, main body 4A of bone fixture 246A has a cylindrical proximate end 1A, a straight, generally cylindrical body, and a screw thread 5.

The distal region 1B of bone fixture 246A may be fitted with self-tapping cutting edges formed in the exterior surface of the fixture. Further details of the self-tapping features that may be used in some embodiments of bone fixtures are described in International Patent Publication WO 2002/009622.

Additionally, as shown in FIG. 2A, the main body of the bone fixture 246A has a tapered apical proximate end 1A, a straight, generally cylindrical body, and a screw thread 5. The distal region 1B of bone fixtures 246A and 246B may also be fitted with self-tapping cutting edges (e.g., three edges) formed into the exterior surface of the fixture.

A clearance or relief surface may be provided adjacent to the self-tapping cutting edges. Such a design may reduce the squeezing effect between the fixture 246A and the bone during installation of the screw by creating more volume for the cut-off bone chips.

As illustrated in FIGS. 2A-2B, flanges 6A and 6B have a planar bottom surface for resting against the outer bone surface, when the bone fixtures have been screwed into the skull. In an exemplary embodiment, flanges 6 have a diameter which exceeds the peak diameter of screw threads 5 (screw threads 5 of bone fixtures 246 may have an outer diameter of about 3.5-5.0 mm) in one embodiment, the diameter of flanges 6 exceeds the peak diameter of screw threads 5 by approximately 10-20%. Although flanges 6 are illustrated in FIGS. 2A-2B as being circumferential, the flanges may be configured in a variety of shapes. Also, the size of flanges 6 may vary depending on the particular application for which the bone conduction implant is intended.

In FIG. 2B, the outer peripheral surface of flange 6B has a cylindrical part 120B and a flared top portion 130B. The upper end of flange 6B is designed with an open cavity having a tapered inner side wall 17. Tapered inner side wall 17 is adjacent to the grip section (not shown).

It is noted that the interiors of the fixtures 246A and 246B further respectively include an inner bottom bore 151A and 151B, respectively, having internal screw threads for securing a coupling shaft of an abutment screw to secure respective abutments to the respective bone fixtures as will be described in greater detail below.

In FIG. 2A, upper end 1A of fixture 246A is designed with a cylindrical boss 140 having a coaxial outer side wall 170 extending at a right angle from a planar surface 180A at the top of flange 6A.

In the embodiments illustrated in FIGS. 2A and 2B, flanges 6 have a smooth, open upper end. The smooth upper end of the flanges and the absence of any sharp corners provides for improved soft tissue adaptation. Flanges 6A and 6B also comprise a cylindrical part 120A and 120B, respectively, that together with the flared upper parts 130A and 130B, respectively, provides sufficient height in the longitudinal direction for internal connection with the respective abutments that may be attached to the bone fixtures.

Figure 3:
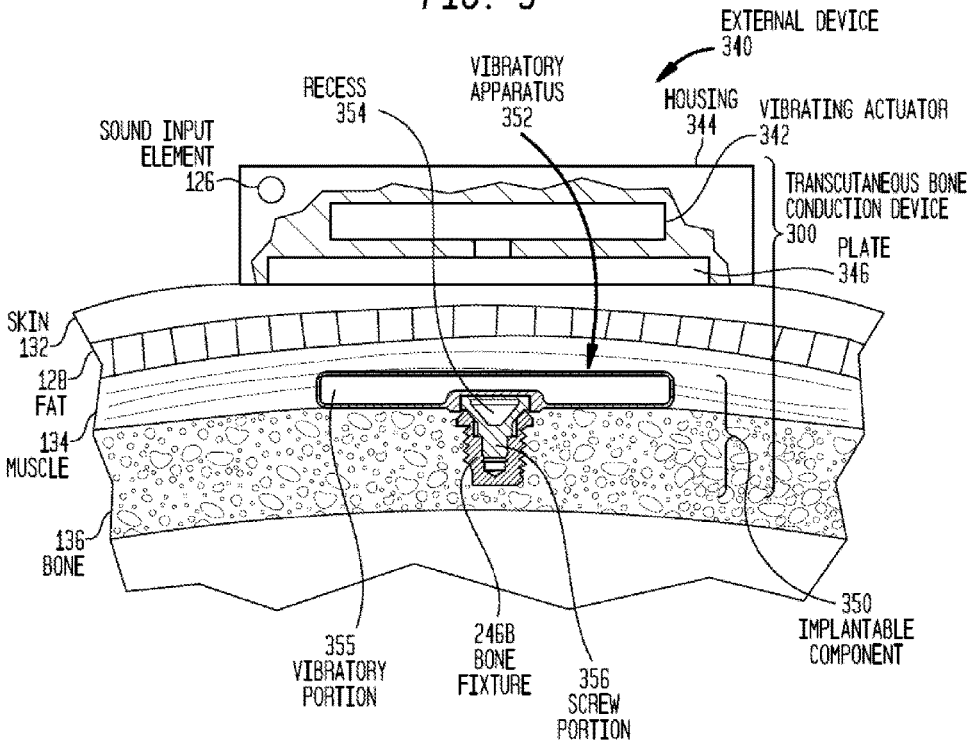
FIG. 3 is a cross-sectional view of a passive transcutaneous bone conduction device using a magnetic coupling.

FIG. 3 depicts an exemplary embodiment of transcutaneous bone conduction device 100, referred to herein as transcutaneous bone conduction device 300. Device 300 includes an external device 340 and an implantable component 350. Device 300 is referred to as a passive transcutaneous bone conduction device because a vibrating actuator 342 is located in external device 340. Vibrating actuator 342 is located in housing 344 and is coupled to plate 346. Plate 346 may be in the form of a permanent magnet and/or in another form that generates and/or is reactive to a magnetic field, or otherwise permits the establishment of magnetic attraction between the external device 340 and the implantable component 350 sufficient to hold the external device 340 against the skin of the recipient.

In an exemplary embodiment, vibrating actuator 342 converts electrical signals into vibrations. In operation, sound input element 126 converts ambient sound into electrical signals which are provided to a sound processor (not shown). The sound processor processes the electrical signals to generate control signals which are provided to vibrating actuator 342. Vibrating actuator 342 generates vibrations in response to the control signals. Because vibrating actuator 342 is mechanically coupled to plate 346, the vibrations are transferred from the actuator to the plate. Vibratory apparatus 352, which is in the form of an implantable magnetic assembly, includes a permanent magnet or magnets (not shown) hermetically sealed in a housing. In other embodiments, rather than magnets, the housing may hold ferromagnetic material that is reactive to a magnetic field, or otherwise permits the establishment of a magnetic attraction between external device 340 and implantable component 350 sufficient to hold the external device against the recipient's skin. As can be seen, the housing includes a vibratory portion 355.

Accordingly, vibrations produced by vibrating actuator 342 are transferred from plate 346 across the skin to implantable component 350. This may be accomplished as a result of mechanical conduction of the vibrations through the skin, resulting from external device 340 being in direct contact with the skin and/or from the magnetic field between the two plates. These vibrations are transferred without penetrating the skin.

Figure 4:
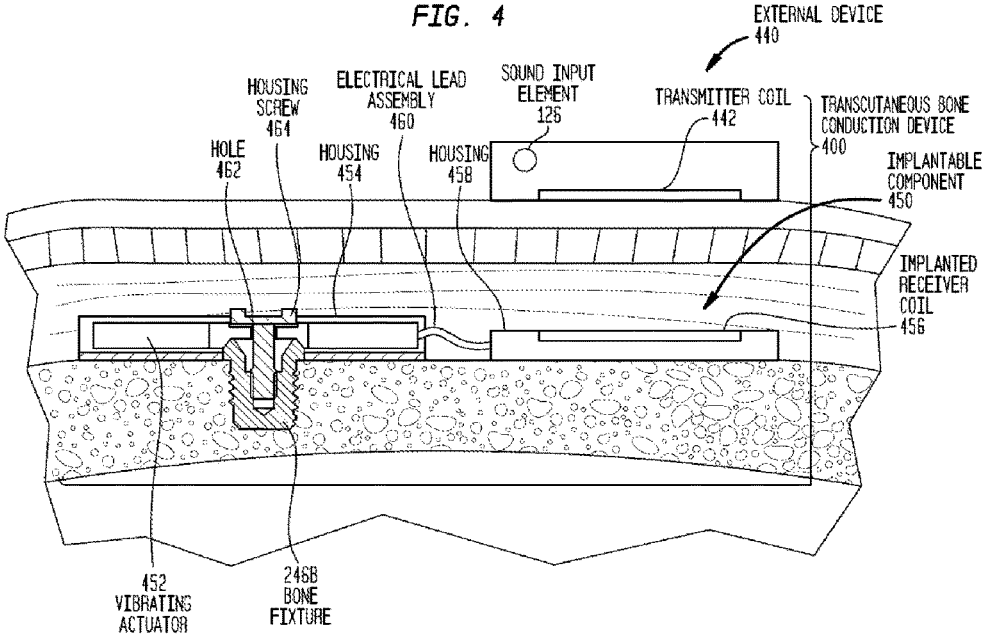
FIG. 4 is a cross-sectional view of an active transcutaneous bone conduction device.

FIG. 4 depicts another embodiment of a transcutaneous bone conduction device 400 that includes an external device 440 and an implantable component 450. The transcutaneous bone conduction device 400 of FIG. 4 is referred to as an active transcutaneous bone conduction device in that the vibrating actuator 452 is located in the implantable component 450. Specifically, a vibratory element in the form of vibrating actuator 452 is located in housing 454 of the implantable component 450. In an exemplary embodiment, much like the vibrating actuator 342 described above with respect to transcutaneous bone conduction device 300, the vibrating actuator 452 is a device that converts electrical signals into vibrations.

External component 440 includes a sound input element 126 that converts sound into electrical signals. Specifically, the transcutaneous bone conduction device 400 provides these electrical signals to vibrating actuator 452, or to a sound processor (not shown) that processes the electrical signals, and then provides those processed signals to the implantable component 450 through the skin of the recipient via a magnetic inductance link. In this regard, a transmitter coil 442 of the external component 440 transmits these signals to implanted receiver coil 456 located in housing 458 of the implantable component 450. Components (not shown) in the housing 458, such as, for example, a signal generator or an implanted sound processor, then generate electrical signals to be delivered to vibrating actuator 452 via electrical lead assembly 460. Vibrating actuator 452 converts the electrical signals into vibrations. Housing 454 is mechanically coupled to bone fixture 246B (by housing screw 464 passing through hole 462) as described herein to facilitate the transfer of vibrations generated by vibrating actuator 452 to bone 136.

Figure 5A:
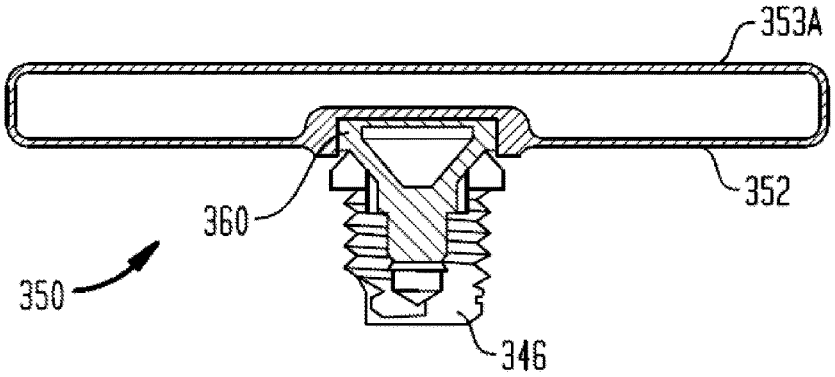
FIG. 5A is a perspective of the bone conduction device of FIG. 3A.
Figure 5B:
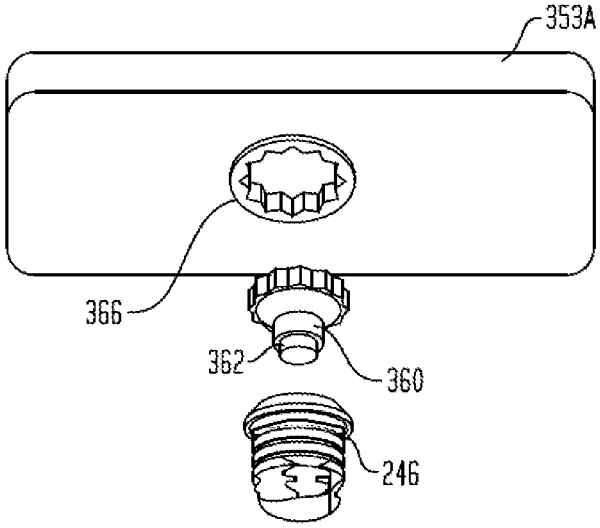
FIG. 5B is an exploded perspective of the bone conduction device of FIG. 3A.
Figure 6:
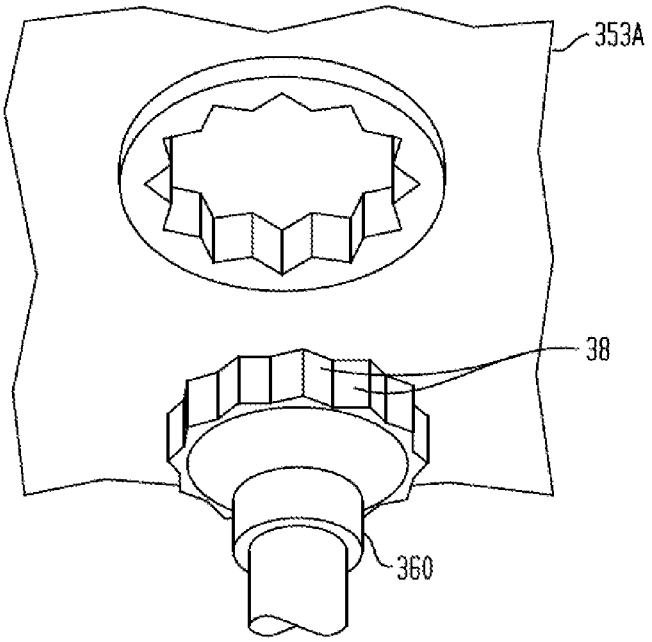
FIG. 6 is an enlarged portion of FIG. 5B.

Now with reference to FIGS. 5A, 5B and 6, implantable magnetic assembly 352 is attached to bone fixture 246 by a magnetic screw 360. Screw 360 attaches to bone fixture 246 with a conventional threaded end 362. Screw head 364 is configured to be received in a recess 366 in magnetic housing 353A and to be retained in that recess by magnetic attraction between the screw 360 and housing 353A or its contents. Head 360 is not so forcefully retained in the recess 366 that it cannot rock in response to trauma or other force applied to either or both of magnetic assembly 352, fixture 246 or both. Head 360 fits in recess 366 having an interior surface that conforms to the perimeter of head 360. As such, head 360 and magnetic assembly 352 cannot rotate relative to each other. Any suitable shapes are usable for head 360 and recess 366. As may be seen in the drawings, one such shape is a series of vertical planes 38 angled relative to each other to form a zigzag shape.

It is noted that while the embodiment of FIG. 3 utilizes a bone fixture 246 having a conical shaped portion that interfaces with screw 360 or other structures, in other embodiments, different bone fixtures may be used that have a cylindrical, multilobular, hexagonal or other polygonal shaped interface. In some such embodiments, the connector or housing structure interfacing with screw 360 may have different structure contoured or adapted to these shapes. Any interface configuration may be implemented provided that the teachings herein and/or variations thereof may be practiced. It should also be appreciated that while the embodiment illustrated in FIG. 3 utilizes screw 356, other coupling components may be utilized to secure vibrating apparatus 352 to bone fixture 246B.

Figure 7:
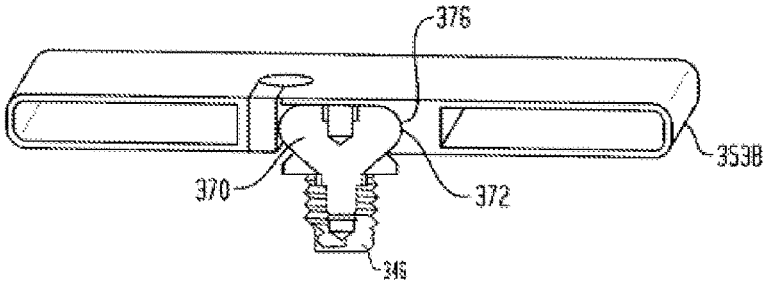
FIG. 7 is a perspective cross-sectional view of a bone conduction device with a ball joint connection between the bone fixture and a magnetic component.
Figure 8:
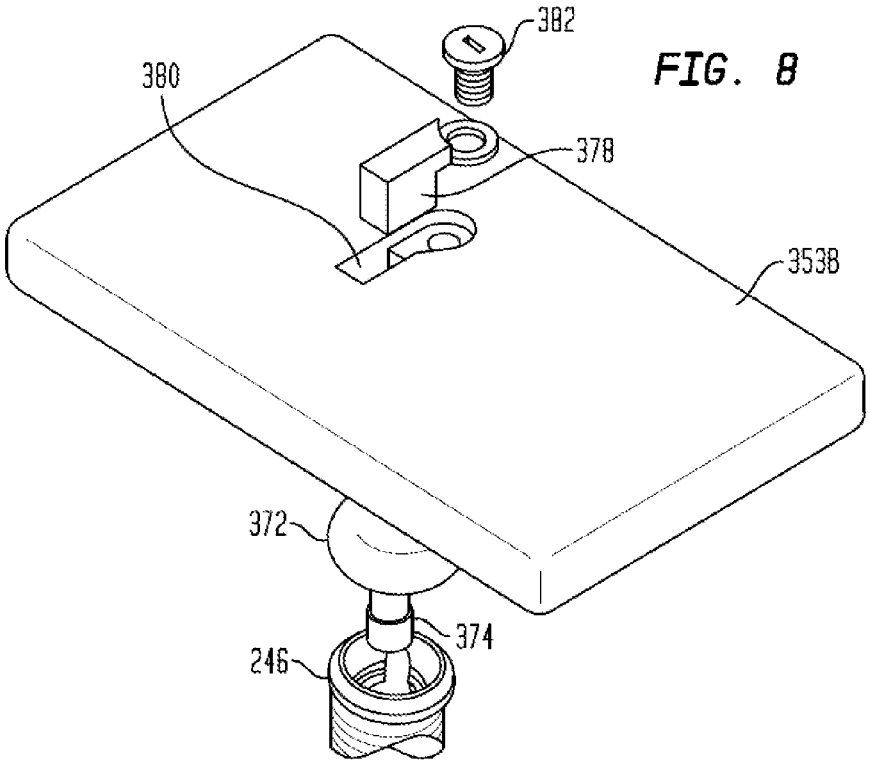
FIG. 8 is an exploded perspective view of the bone conduction device of FIG. 7.

Another embodiment of this disclosure is illustrated in FIGS. 7 and 8. In this embodiment a magnetic assembly 352 is attached to bone fixture 246 by a coupling component in the form of a "ball joint" screw 370 having an ovoid or bulging, rounded shape head 372 attached to a conventional screw end 374. Screw 370 head 372 is received in an appropriately-shaped recess 376 in magnetic housing 353B and is retained in the recess by a lock-piece 378 inserted through a lock-receiving slot 380 in magnetic housing 353B and is retained there by a screw 382 that drives into housing 353B. Lock-piece 378 itself retains screw 370 head 372 in housing 353B, but there is sufficient clearance between the lock-piece 378, head 372 and housing 353B that housing 353B can move (tilt and/or rotate) relative to bone fixture 246 in response to trauma or other forces.

A spring connection between the implant, flexible spring screw, and the magnet implant structure, provides flexibility against trauma forces. The magnet implant can be partly submerged or fully submerged in the skull and could have a curved shape to fit the skull.

In alternative embodiments, magnetic housing 353 may include one or multiple internal magnets encapsulated into biocompatible material. In other embodiments, magnetic housing 353 may have different shapes or have two or more separate magnetic housings connected to a frame.

Figure 9:
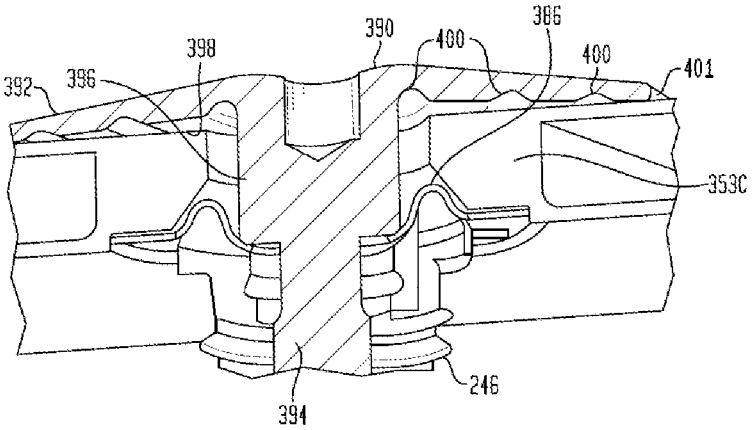
FIG. 9 is an enlarged perspective cross-sectional view of another embodiment of a bone conduction device of this disclosure incorporating a spring plate.

FIG. 9 illustrates an enlarged fragmentary cross section of an embodiment in which a wave spring 386 provides somewhat flexible, sealing engagement between bone fixture 246 and housing 353C. A flexible spring screw 390 affords flexibility to accommodate trauma forces. In this embodiment, housing 353C is secured to bone fixture 246 by a flexible spring screw 390 having a large-diameter, diaphragm-like head 392 attached to a flexible screw shank 394 protruding from a flexible boss 396 that protrudes from the underside of spring screw 390 head 392. In some embodiments, head 392 is also flexible. For example, in this illustrative embodiment, head 392 is large in diameter, thin, slightly domed, and the underside 398 is formed with an annular recesses 400 to make it more flexible. Wave spring 386 geometry and flexibility of spring screw 390 provide a capacity for some movement of magnet housing 353C relative to bone fixture 246 to accommodate trauma forces.

In some embodiments, the edge 401 of head 392 has a sharp corner as shown in FIG. 9 that is configured to permanently deform when spring screw 390 is secured to housing 353C. This minimizes or prevents bodily fluids from migrating between head 392 and housing 353C.

Figure 10:
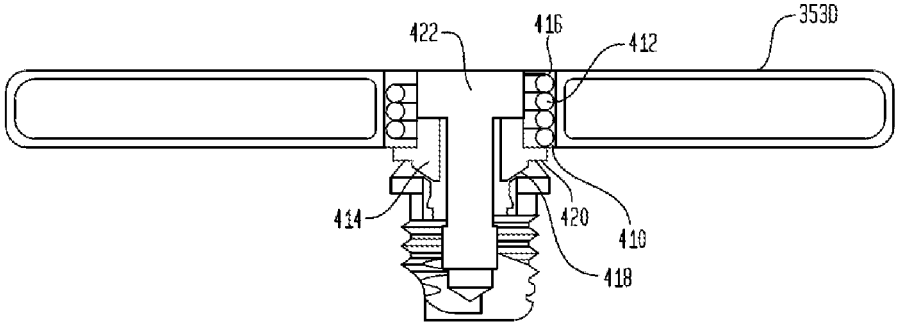
FIG. 10 is an enlarged perspective cross-sectional view of another embodiment of a bone conduction device of this disclosure incorporating a coiled spring.

In one embodiment A spring joint with a coiled spring connection between the implant and the magnet implant structure can also provide for flexibility against trauma forces. Such a coiled spring embodiment is illustrated in FIG. 10, where a lower end 410 of a coiled spring 412 is attached to an implant interface 414 and the upper end 416 of spring 412 is connected to magnet housing 353D. Spring 412 can be pre-stressed stainless steel or titanium. The spring 412 can be welded or otherwise mechanically secured the housing 353D and to the implant interface 414. Implant interface 414 is configured to seat on bone fixture 246 with conical annular surface 418 and flange 420 seating against mating structures of bone fixture 246. These contact regions of interface 414 can, of course, be modified for other bone fixture geometries. The spring package (connected to the magnet and implant structure 353D) is held in place with a screw 422.

Figure 11:
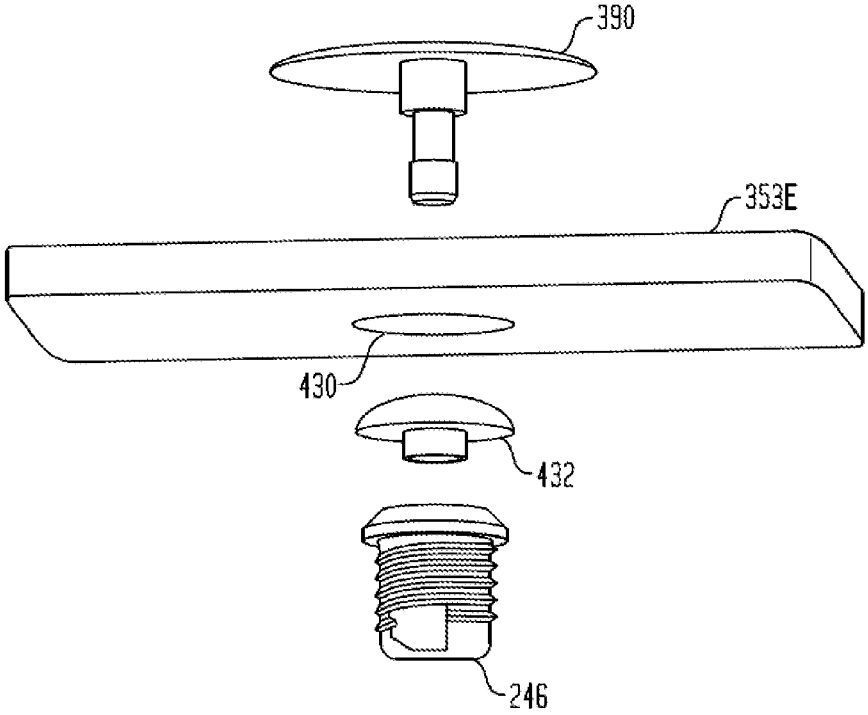
FIG. 11 is an exploded perspective view of another embodiment of a bone conduction device of this disclosure.

FIG. 11 illustrates a magnet implant housing 353E that is penetrated by a screw hole (not shown) and has a concave recess 430 that rests on a semi-spherical or convex implant interface 432 that is connected to the bone fixture 246. Magnet implant housing 353E is secured to bone fixture 246 by an embodiment of spring screw 390 described above with reference to FIG. 9. Concave recess 430 and convex implant interface 432 have conformal surfaces such that the two surfaces are drawn into sealing contact when spring screw 390 is secured to bone fixture 246. In response to trauma forces applied to housing 353E, spring screw 390 will flex and the surface of concave recess 430 will slide over the surface of convex implant interface 432 thereby allowing housing 353E to move relative to bone fixture 246.

While various embodiments of the present disclosure have been described above, it should be understood that they have been presented by way of example only, and not limitation. It will be apparent to persons skilled in the relevant art that various changes in form and detail can be made therein without departing from the spirit and scope of the invention. For example, embodiments described above with reference to magnetic housing 353. Thus, the breadth and scope of the present disclosure should not be limited by any of the above-described exemplary embodiments, but should be defined only in accordance with the following claims and their equivalents.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below and their equivalents.

What is claimed is:

1. A device, comprising:

an implantable assembly of a passive transcutaneous bone conduction device, including:

a bone fixture configured to anchor to bone of a recipient; and a vibratory apparatus configured to be completely implanted beneath the skin of a recipient, wherein the implantable assembly is configured such that the vibratory apparatus can move relative to the bone fixture while implanted in a recipient, any cavity defined by the bone fixture is open, and at least one of:

(i) the implantable assembly is configured such that the implantable vibratory apparatus at least one of tilts or rotates; or (ii) the vibratory apparatus is part of an assembly that is configured to be exposed to body fluid when implanted in the recipient, wherein the bone fixture is a separate component from the assembly.

2. The device of claim 1, wherein:

the implantable assembly is configured such that upon application of a force to the vibratory apparatus, the vibratory apparatus rocks relative to the bone fixture.

3. The implant of claim 1, wherein the implantable assembly is configured to prevent rotation of the vibratory apparatus relative to the bone fixture.

4. The device of claim 1, wherein:

the implantable assembly is configured such that the implantable vibratory apparatus at least one of tilts or rotates relative to the bone fixture.

5. The device of claim 1, wherein:

the implantable assembly includes a ball joint that enables the vibratory apparatus to move relative to the bone fixture.

6. The device of claim 1, wherein:

the implantable assembly includes a coil spring; and the vibratory apparatus is coupled to the bone fixture via the coil spring.

7. The device of claim 1, wherein:

the implantable assembly is configured such that the vibratory apparatus can move relative to the bone fixture while implanted in a recipient completely underneath the skin of the recipient while remaining completely attached to the bone fixture.

8. The device of claim 1, wherein the implantable assembly includes a fastener, wherein the fastener extends completely through the vibratory apparatus and is screwed into the bone fixture, wherein the implantable assembly is configured such that the vibratory apparatus can move relative to the fastener and the bone fixture while implanted beneath the skin of the recipient and while the fastener is screwed into the bone fixture fully securing the vibratory apparatus to the bone fixture.

9. The device of claim 1, wherein:

the bone fixture is a threaded screw apparatus.

10. The device of claim 1, wherein:

the vibratory apparatus includes a housing that is a separate component from the bone fixture.

11. The device of claim 1, wherein:

the vibratory apparatus is part of the assembly that is configured to be exposed to body fluid when implanted in the recipient, wherein the bone fixture is the separate component from the assembly.

12. The device of claim 1, wherein:

the implantable assembly is configured such that the vibratory apparatus can move relative to the bone fixture outside any hollow portion of the bone fixture.

13. The device of claim 1, wherein:

the implantable assembly is configured such that the implantable vibratory apparatus at least one of tilts or rotates.

14. A device, comprising:

an implantable assembly, including:

a bone fixture configured to anchor to bone of a recipient;

an apparatus configured to be completely implanted beneath the skin of a recipient; and a coupling component configured to couple the apparatus to the bone fixture such that the apparatus is spaced away from the bone fixture, wherein at least one of:

the coupling component is splined to the apparatus, and wherein the apparatus is configured to move relative to the bone fixture;

the apparatus is a passive component;

the coupling component is flexible, thereby enabling movement of the apparatus relative to the bone fixture, the flexible component being a component configured to be exposed to body fluids of the recipient; or the implantable assembly is configured such that the apparatus and the coupling component are attracted to one another via magnetic attraction.

15. The device of claim 14, wherein:

at least one of the apparatus and the coupling component are configured such that the apparatus can move relative to the bone fixture.

16. The device of claim 14, wherein:

the coupling component is flexible, thereby enabling movement of the apparatus relative to the bone fixture.

17. The device of claim 14, wherein:

the implantable assembly is configured such that the apparatus and the coupling component are attracted to one another via magnetic attraction.

18. The device of claim 14, wherein:

device is a transcutaneous bone conduction device; and the apparatus is a vibratory apparatus of one of a passive transcutaneous bone conduction device or an active transcutaneous bone conduction device.

19. The device of claim 14, wherein:

the coupling component is splined to the apparatus, and wherein the apparatus is configured to move relative to the bone fixture.

20. The device of claim 14, wherein:

device is a transcutaneous bone conduction device; and the apparatus is a vibratory apparatus of an active transcutaneous bone conduction device.

21. The device of claim 14, wherein:

the implantable assembly is configured to be completely implanted in the recipient and wherein the implantable assembly is configured such that the apparatus and the coupling component are attracted to one another solely via magnetic attraction.

22. The device of claim 14, wherein:

the coupling component is configured to couple the apparatus to the bone fixture such that the apparatus is fully secured to the bone fixture while the coupling component is present, wherein the coupling component is flexible, thereby enabling movement of the apparatus relative to the bone fixture while retaining full securement of the apparatus to the bone fixture.

23. The device of claim 14, wherein:

the coupling component is flexible, thereby enabling movement of the apparatus relative to the bone fixture, the flexible component being the component configured to be exposed to body fluids of the recipient.

24. The device of claim 14, wherein:

the apparatus is the passive component.

25. The device of claim 14, wherein:

the device is configured such that upon application of a force to the apparatus, the apparatus rocks relative to the bone fixture.

26. A device, comprising:

an implantable assembly of a transcutaneous bone conduction device, including:

a bone fixture configured to anchor to bone of a recipient; and a vibratory apparatus configured to be completely implanted beneath the skin of a recipient, wherein the implantable assembly includes a coupling system comprising a portion having a concave first component, relative to a location of the bone fixture, wherein the coupling system is configured to retain a portion of the implantable assembly adjacent the concave first component, thereby coupling the vibratory apparatus to the bone fixture, and at least one of:

the device further comprises a coupling apparatus that extends through a through hole in the vibratory apparatus and is coupled to the bone fixture, the coupling apparatus including the concave first component, wherein the concave first component establishes a seal between the coupling apparatus and the vibratory apparatus;

the implantable assembly includes a second component that is removably coupled to the bone fixture, wherein the second component includes a convex surface, relative to a location of the concave first component, that interfaces with a concave surface of the vibratory apparatus;

the vibratory apparatus is a passive component;

the bone fixture is concentric with the concave first component; or with respect to a view looking downward along a longitudinal axis of the bone fixture, with the bone fixture behind the vibratory apparatus, the bone fixture is directly underneath an area established by the concave first component.

27. The device of claim 26, further comprising:

the coupling apparatus that extends through the through hole in the vibratory apparatus and is coupled to the bone fixture, the coupling apparatus including the concave first component, wherein the concave first component establishes the seal between the coupling apparatus and the vibratory apparatus.

28. The device of claim 26, wherein:

the implantable assembly includes the second component that is removably coupled to the bone fixture, wherein the second component includes the convex surface, relative to the location of the concave first component, that interfaces with the concave surface of the vibratory apparatus.

29. The device of claim 26, wherein:

device is a transcutaneous bone conduction device; and the vibratory apparatus is a vibratory apparatus of an active transcutaneous bone conduction device.

30. The device of claim 26, wherein one of:

the vibratory apparatus includes a housing and a vibrator that vibrates upon application of an electrical current thereto, and the concave portion is part of the housing; or the vibratory apparatus is a plate apparatus configured to receive vibrations transmitted through skin of the recipient, and the concave portion is part of a housing.

31. The device of claim 26, wherein:

the vibratory apparatus is configured to be implanted beneath skin of the recipient behind an outer ear of the recipient and away from the outer ear of the recipient above bone of the recipient over which is located skin that substantially conforms to a surface of the bone over which the skin lies; and the vibratory apparatus is a plate apparatus configured to receive vibrations transmitted through skin of the recipient, and the concave portion is part of a component that envelops the plate apparatus.

32. The device of claim 26, wherein:

an axis of symmetry of the concavity of the first component is parallel to a longitudinal axis of the bone fixture.

33. The device of claim 26, wherein:

the bone fixture is concentric with the concave first component.

34. The device of claim 26, wherein:

with respect to the view looking downward along the longitudinal axis of the bone fixture, with the bone fixture behind the vibratory apparatus, the bone fixture is directly underneath the area established by the concave first component.

35. The device of claim 26, wherein:

the vibratory apparatus is the passive component.

36. A device, comprising:

an implantable assembly of a transcutaneous bone conduction device, including:

a bone fixture configured to anchor to bone of a recipient; and a vibratory apparatus configured to be completely implanted beneath the skin of a recipient, wherein the implantable assembly includes a coupling system comprising a portion having a concave first component, relative to a location of the bone fixture, wherein the coupling system is configured to retain a portion of the implantable assembly adjacent the concave first component, thereby coupling the vibratory apparatus to the bone fixture, the implantable assembly includes a second component that is removably located within the recess and is coupled to the bone fixture, the implantable assembly includes a third component configured to be removably fixed within the recess such that the third component blocks removal of the second component from the recess, thereby releasably coupling the vibratory apparatus to the bone fixture, and at least one of:

the concave first component is part of a recess within the vibratory apparatus; or only in the absence of the third component within the recess, the second component is removable from the recess.

37. The device of claim 36, wherein:

the implantable assembly includes the second component that is removably located within the recess and is coupled to the bone fixture; and the implantable assembly includes the third component configured to be removably fixed within the recess such that the third component blocks removal of the second component from the recess, thereby releasably coupling the vibratory apparatus to the bone fixture, wherein only in the absence of the third component within the recess, the second component is removable from the recess.

* * * * *